United States Patent [19]

Mandelbaum

[11] 4,133,445

[45] Jan. 9, 1979

[54] PILL DISPENSING AND STORAGE DEVICE

[76] Inventor: Isidore Mandelbaum, 803 Springmill La., Indianapolis, Ind. 46260

[21] Appl. No.: 784,734

[22] Filed: Apr. 5, 1977

[51] Int. Cl.[2] ..... B65D 21/02

[52] U.S. Cl. ..... 220/23.4; 206/537; 206/504

[58] Field of Search ..... 220/234; 206/504, 538, 206/537; 46/25

[56] References Cited

U.S. PATENT DOCUMENTS

| | | | |
|---|---|---|---|
| D. 236,585 | 9/1975 | Tabor | D9/18 |
| 2,706,464 | 4/1955 | North | 206/459 |
| 2,776,521 | 1/1957 | Zimmerman | 46/25 |
| 3,120,152 | 7/1964 | Horn et al. | 220/23.4 |
| 3,131,829 | 5/1964 | Masser | 220/23.4 |
| 3,308,452 | 8/1967 | Oakley et al. | 220/23.4 |
| 3,366,265 | 1/1968 | Hesselbarth | 220/23.4 |
| 3,404,818 | 10/1968 | Miscoe | 220/23.4 |
| 3,862,683 | 1/1975 | Koelichen | 220/23.4 |
| 3,985,229 | 10/1976 | Maki | 220/23.4 |

FOREIGN PATENT DOCUMENTS

| | | | |
|---|---|---|---|
| 965155 | 6/1957 | Fed. Rep. of Germany | 220/23.4 |
| 649541 | 1/1951 | United Kingdom | 220/23.4 |

*Primary Examiner*—William Price
*Assistant Examiner*—Joseph Man-Fu Moy
*Attorney, Agent, or Firm*—Terry M. Gernstein

[57] ABSTRACT

A unit including a multiplicity of detachably connected containers. The individual containers each have fastening elements thereon which engage fastening elements of other containers to interlock adjacent containers together in a manner which enables each container to be detached from an adjacent container for use and then reattached to an adjacent container after use.

9 Claims, 4 Drawing Figures

PILL DISPENSING AND STORAGE DEVICE

BACKGROUND OF THE INVENTION

The present invention relates in general to containers, and more particularly to plural use medicinal containers.

Many patients who are treated in physicians' offices and in hospitals are given prescriptions for several drugs. Often, these prescriptions include medications for infections, or pain, cardiac drugs, and sometimes diuretics, and the like.

There are many devices known for carrying such medicines, and the so-called "pillbox" is very common. However, these devices suffer many drawbacks. For example, to be carried in the known devices of the "pillbox" type, the drugs should be in pellet form, and these pellets often become intermingled leaving the user to guess as to the identity of a particular pellet. Intermixing of drugs can obviously have very adverse effects. Furthermore, these devices have no means for containing instructions and the like for the individual drugs.

There are also several single use devices known. These devices include assemblies of several containers connected together by break joints which are broken apart to separate containers from the unit. Once separated, the containers cannot be rejoined, and thus, once the contents thereof are used, a container is discarded. The containers are, therefore, amenable to only a single use. Such single use, non-reusable containers are expensive and the break joints are often difficult to operate.

Often, patients will simply carry a plurality of pharmaceutical bottles in a bag. Such a method of transporting medicine is not desirable, as the individual bottles may easily become lost, broken or misplaced, and such bags are often bulky.

SUMMARY OF THE INVENTION

The unit embodying the teachings of the present invention has a plurality of individual containers coupled together in a manner which facilitates easy detachment from and reattachment to the unit of individual containers.

The unit comprises a plurality of containers with each container having fastening elements integral therewith. The fastening elements each include a tongue element and a gripping jaw element each of which is located on diametrically opposite sides of the container.

Tongue elements are forced into engagement with the gripping jaw elements to interlock the two elements together and thereby interjoin a pair of adjacent containers. The containers can be separated and then relocked together.

The individual containers can each include appropriate identifying, instructing and warning indicia and can be small relative to the usual size of such containers. A large container can be kept in a convenient location and the individual containers of the unit can be refilled therefrom. Thus, the unit embodying the teachings of the present invention can include a multiplicity of containers, yet still be of such a size as to be conveniently carried by a user. Alternatively, the drugs can be sold in containers suitable for use in the unit of the subject invention.

The containers can accommodate drugs in any form such as liquid, powder or pellet forms. Using appropriate caps, which preferably are child-proof, the containers can be adapted to dispense whatever drug is contained in a container, in whatever dosage is suitable.

The indicia appearing on each container can be used to provide information as to the nature of each drug, dosage, as well as potential side effects. Possible drug interactions might therefore be quickly diagnosed, as each medication is carried side-by-side in a single master packet. Thus, should a patient be seen by a doctor unfamiliar with the patient's medicinal regimen, a glance at the unit of containers by that doctor will provide much useful information.

OBJECTS OF THE INVENTION

It is, therefore, a main object of the present invention to provide a unit of compact, easily portable, reusable discrete containers.

It is another object of the present invention to provide a unit of reusable discrete containers which includes containers which can be detached and reattached to the unit expeditiously.

It is a further object of the present invention to provide a unit of reusable discrete containers which is amenable to easy storage on a user's person.

It is yet another object of the present invention to provide a unit of reusable discrete containers which includes individually marked containers.

It is yet a further object of the present invention to provide a unit of reusable discrete containers which includes replenishable containers.

It is a specific object of the present invention to provide a compact reusable pill dispensing and storage device wherein six containers can be attached together and still be small enough to easily fit into a purse or jacket pocket.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
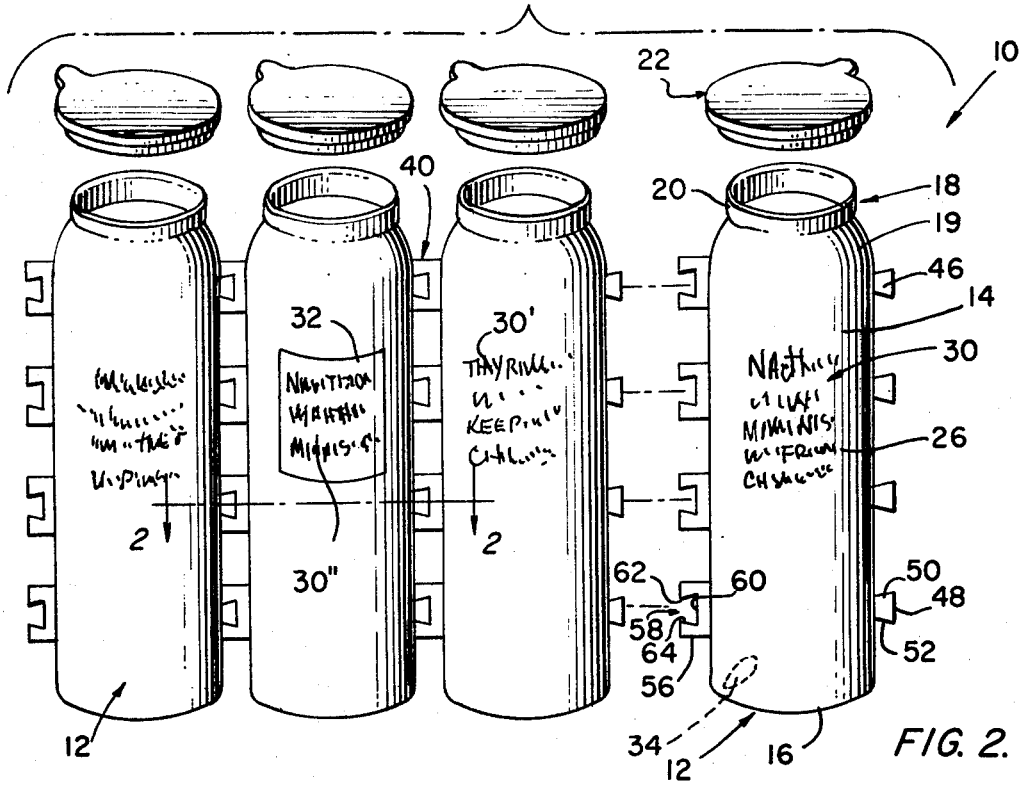
FIG. 1 is an elevation view of a unit embodying the teachings of the present invention.

Shown in FIG. 1 is a cluster of interjoined containers forming an assembly or multi-modular unit which is generally denoted by the numeral 10 and can be used to store items, such as pills, and the like, which are often carried on the person. The unit 10 includes a plurality of discrete containers 12, each having a central body portion 14. The containers 12 can be bottle-shaped. The central body portion is tubular and includes a base portion 16 on one end thereof and a mouth portion 18 on the other end thereof. The mouth portion 18 is connected to the body portion via a curved shoulder portion 19. The mouth portion is cylindrical and has a neck portion 20 which has a diameter smaller than the diameter of the body portion and on which is mounted a closure cap 22. The cap 22 serves the usual purpose of closing the container, and is preferably of the child-proof variety.

The containers 12 are elongate and have lateral portions 26 which preferably are translucent with indicia 30 either embossed thereon, as shown at 30', or mounted on a label 32 as shown at 30''. The indicia is characteristic of the contents of the containers, such as pill 34, and contain suitable identifying material, warnings, dosage, or other instructions.

Integrally mounted on each container lateral portion are a plurality of fastening members 40. Each fastening member is independent of the other fastening members and the members are spaced apart longitudinally of the container. As shown in the Figures, the fastening members are aligned and mounted so that the containers can be arranged in a side-by-side co-planar configuration if desired.

The fastening members form a detachable-reattachable coupling for the containers which enables contiguous containers to be pulled apart as desired, and then recombined into the interlocked configuration.

Each of the fasteners shown in FIG. 1 forms a half-blind snap fastener which includes a trapezoidally shaped tongue 46 integrally mounted on the container along one of the parallel sides thereof to extend radially outward of the container and to have the parallel edges thereof oriented to extend longitudinally of the container. The tongue minor base is integral with the container lateral portion and the major base forms free end 48 with the non-parallel sides forming edges 50 and 52. By attaching the minor base to the container, the edges 50 and 52 are outwardly divergent therefrom.

The tongues 46 form a male element of the fasteners. The female element of each of the fasteners is formed by gripping jaws 56 integrally mounted on each container lateral portion in a position thereon which is diametrically opposed to the male elements and at the same longitudinal position and spacing on the container as the tongue elements. In this manner, each tongue element has a corresponding gripping jaw element.

The gripping jaw elements are integrally mounted at one end thereof on a container lateral portion to extend radially outward therefrom, and have defined therein at the free end thereof a blind-ended opening 58. The opening 58 is trapezoidally shaped to correspond to and accommodate a tongue 46. The gripping jaw opening therefore includes a base edge 60 positioned to be in spaced parallelism with the outer perimeter of the container, and a pair of non-parallel sides 62 and 64 which are inwardly divergent of the opening 58. The sides 62 and 64 therefore contact edges 50 and 52 when a tongue 46 is accommodated in a gripping jaw 56. The non-parallel nature of the edges produces the interlocking engagement of the elements 46 and 56 of the fasteners to thereby releasably couple together adjacent containers.

Figure 2:
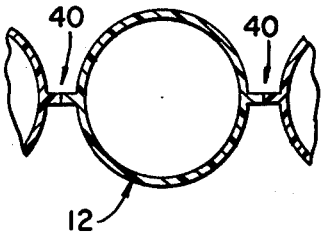
FIG. 2 is a plan view taken along line 2—2 of FIG. 1.

The fasteners can be sized to provide any suitable spacing between interlocked containers. The fit between the tongue and gripping jaw can be of any suitable snugness, and these elements can be formed of any suitable material, such as a yieldable plastic material. Engagement of the fastener elements can be effected by a snap fit wherein the elements are snapped together using uniplanar movement thereof with yieldable movement of the elements, or a meshing fit wherein movement of the elements relative to each other occurs in a plane different from the plane containing those elements. In the case of a meshing fit, the elements need not be formed in a yieldable manner. The thickness of the elements is indicated in FIG. 2 wherein the elements are formed of the same material as the containers.

Figure 3:
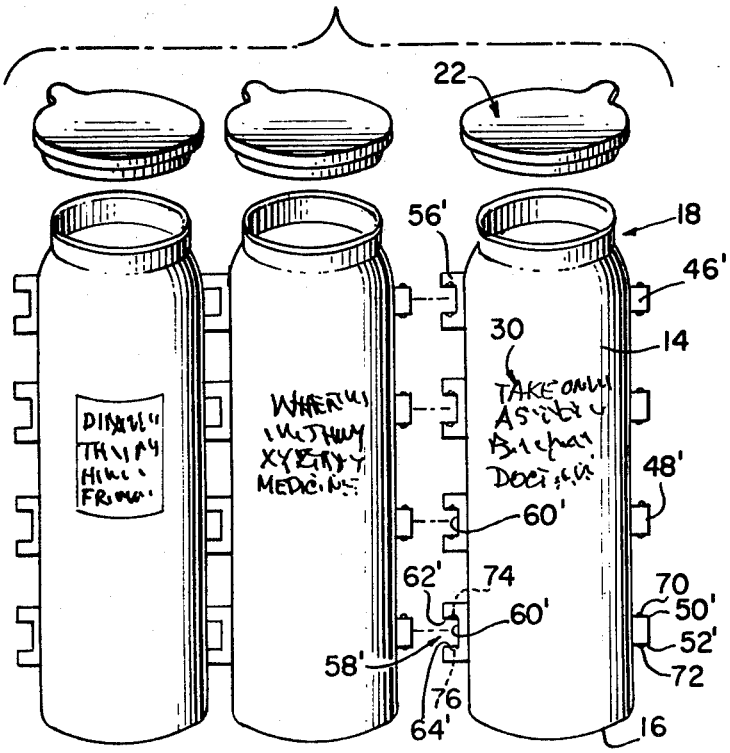
FIG. 3 is an elevation view of another unit embodying the teachings of the present invention.
Figure 4:
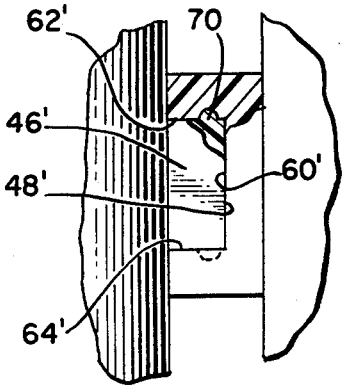
FIG. 4 is a view of a coupling used in a unit embodying the teachings of the present invention.

An alternative form of the fastening members is shown in FIGS. 3 and 4 and includes tongue elements 46' which are square and gripping jaws 56' which has a square receiving opening 58' defined therein. Beads 70 and 72 are each positioned on one of the tongue side edges 50' and 52' to project longitudinally of the container. Dimples 74 and 76 are defined in side edges 62' and 64' of the gripping jaw opening 58' and are sized and positioned to accommodate the beads as shown in FIG. 4 to effect detachable interlocking of adjacent containers.

As the tongue 46' is forced into the opening 58', the beads contact the sides 62' and 64', and thus one or the other of these elements should be somewhat yieldable. When the tongue is fully inserted into the fastener with free edge 48' abutting bottom edge 60' of the gripping jaw opening, the beads are received in the dimples to lock the fastening elements together. The beads can be shaped to be semi-spherical, as shown in FIG. 3, or conically shaped, or cylindrically shaped, as desired. The semi-spherical shape is preferred as such a shape facilitates locking and unlocking of the fasteners better than the other just-mentioned shapes.

As with the preferred embodiment of the unit, the fastening and unfastening movements of the containers can be planar with respect to the fastening elements, or at an angle with respect to the planes containing those elements.

Use of the afore-discussed containers is evident, and is therefore presented here in summary form only. The containers are fastened together in a detachable-reattachable manner so that the contents of each individual container can be used, replaced, or the like, without requiring the entire cluster to be disturbed. After use, each container is replaced in the cluster and reattached to an adjacent container. The fastening members permit easy and expeditious detachment and reattachment of the containers. The containers can be manufactured in several sizes, shapes or colors to further identify the contents thereof, and a multiplicity of diverse and disparate containers can be interlocked together to form a single unit which can be easily and conveniently stored and used. The planar shape of the unit 10 is preferred; however, circular shapes, or the like, may also be desirable. The other shapes can be selected by adjusting the position and/or orientation of the fastener elements relative to each other and/or to the containers.

The preferred embodiment of the unit includes two to six containers, each being about 6 centimeters long and 2 centimeters in diameter at the base. The preferred material is plastic, but other materials, such as glass, wood or supported cloth, can be used. The material is preferably translucent, but can be dark or opaque if the medications are light sensitive.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A unit of reusable containers for storing medicine and the like comprising:

a plurality of separate containers each container having an elongate body portion having a longitudinal dimension and which is closed at one end and open at the other end thereof;

a closure cap for each container which engages the open end of each container body portion to close said each container body portion;

a projecting locking element mounted on each container body portion, said first locking element having an outer perimeter;

a gripping jaw element mounted on each container body portion, said gripping jaw element having a pair of spaced projecting members and a base having an edge spaced from said container body and connecting said projecting members together to define a blind-ended opening, said gripping jaw element being mounted on said container body portion so that said blind-ended opening is coplanar with a plane intersecting said container body portion so that said projecting members are spaced apart along the longitudinal dimension of said container body portion, said gripping jaw elements having means for gripping said locking element so that a gripping jaw element of one container releasably locks with a projecting locking element of an adjacent container to couple those adjacent containers together so that a unit formed of the coupled containers can assume a curved configuration, whereby said unit can be carried in a pocket, said projecting and gripping jaw elements being reconnectable with each other after separation.

2. A unit of reusable containers for storing medicine and the like comprising:

a plurality of separate containers each container having an elongate body portion having a longitudinal dimension and which is closed at one end and open at the other end thereof;

a closure cap for each container which engages the open end of each container body portion to close said each container body portion;

a flat tongue element mounted on each container body portion, said tongue element having a pair of oppositely presented flat faces, a pair of side edges and a free edge bordering said flat faces, said tongue element being connected to said body portion along another edge thereof so that said flat faces are coplanar with a plane intersecting said container body portion and so that said side edges are spaced apart along the longitudinal dimension of said body portion;

a gripping element mounted on each container body portion, said gripping element having projecting means thereon and a base having an edge spaced from said container body and connecting said projecting means together to define a blind-ended opening and being mounted on said container body portion so that at least some portions of said projecting means are spaced apart along the longitudinal dimension of said container body portion, said gripping jaw elements having means for gripping said tongue element so that a gripping element of one container releasably locks with a flat tongue element of an adjacent container to couple those adjacent containers together so that a unit formed of the coupled containers can assume a curved configuration, whereby said unit can be carried in a pocket, said flat tongue and gripping elements being reconnectable with each other after separation.

3. A reusable container comprising:

an elongate container body portion having a longitudinal dimension and which is closed at one end thereof;

a closure cap which engages the other end of said container body portion to close said body portion;

a projecting locking element mounted on each container body portion, said first locking element having an outer perimeter;

a gripping jaw element mounted on each container body portion, said gripping jaw element having a pair of spaced projecting members and a base having an edge spaced from said container body connecting said projecting members together to define a blind-ended opening, said gripping jaw element being mounted on said container body portion so that said blind-ended opening is coplanar with a plane intersecting said container body portion and so that said projecting members are spaced apart along the longitudinal dimension of said container body portion, said gripping jaw elements having means for gripping said locking element so that a gripping jaw element of one container releasably locks with a projecting locking element of an adjacent container to couple those adjacent containers together so that a unit formed of the coupled containers can assume a curved configuration, whereby said unit can be carried in a pocket, and projecting and gripping jaw elements being reconnectable with each other after separation.

4. A reusable container comprising:

an elongate container body portion having a longitudinal dimension and which is closed at one end thereof;

a closure cap which engages the other end of said container body portion to close said body portion;

a flat tongue element mounted on each container body portion, said tongue element having a pair of oppositely presented flat faces, a pair of side edges and a free edge bordering said flat faces, said tongue element being connected to said body portion along another edge thereof so that said flat faces are coplanar with a plane intersecting said container body portion and so that said side edges are spaced apart along the longitudinal dimension of said body portion, said tongue element having locking means thereon;

a gripping element mounted on each container body portion, said gripping element having projecting means thereon and a base having an edge spaced from said container body connecting said projecting means together to define a blind-ended opening and being mounted on said container body portion so that at least some portions of said projecting means are spaced apart along the longitudinal dimension of said container body portion, said gripping element engaging said tongue locking means so that a gripping element of one container releasably locks with a flat tongue element of an adjacent container to couple those adjacent containers together so that a unit formed of the coupled containers can assume a curved configuration, whereby said unit can be carried in a pocket, said flat tongue and gripping elements being reconnectable with each other after separation.

5. A unit of reusable containers for storing medicine and the like comprising:

a plurality of separate containers each container having an elongate body portion having a longitudinal dimension and which is closed at one end thereof;

identifying means on each container body portion for providing information regarding the contents of said each container;

a closure cap for each container which engages the other end of each container body portion to close said each container body portion;

a flat tongue element mounted on each container body portion, said tongue element having a pair of oppositely presented flat faces, a pair of side edges and a free edge bordering said flat faces, said tongue element being connected to said body portion along another edge thereof so that said flat faces are coplanar with a plane intersecting said container body portion and so that said side edges are spaced apart along the longitudinal dimension of said body portion;

a gripping jaw element mounted on each container body portion, said gripping jaw element having a pair of spaced projecting members and a base having an edge spaced from said container body and connecting said projecting members together to define a blind-ended opening, said gripping jaw element being mounted on said container body portion so that said blind-ended opening is coplanar with a plane intersecting said container body portion and so that said projecting members are spaced apart along the longitudinal dimension of said container body portion, said gripping jaw elements having means for gripping said tongue element so that a gripping jaw element of one container releasably locks with a tongue element of an adjacent container to couple those adjacent containers together so that a unit formed of the coupled containers can assume a curved configuration, whereby said unit can be carried in a pocket, said tongue and gripping jaw elements being reconnectable with each other after separation.

6. The unit defined in claim 5, wherein said tongue is square and includes a bead on at least one edge thereof, and said gripping jaw tongue receiving means has a dimple defined therein receiving said bead when said tongue is positioned within said tongue receiving means.

7. A reusable container comprising:

an elongate container body portion having a longitudinal dimension and which is closed at one end thereof;

a closure cap which engages the other end of said container body portion to close said body portion;

first fastening means on said container body portion, said first fastening means including a flat tongue element mounted on each container body portion, said tongue element having a pair of oppositely presented flat faces, a pair of side edges and a free edge bordering said flat faces, said tongue element being connected to said body portion along another edge thereof so that said flat faces are coplanar with a plane intersecting said container body portion and so that said side edges are spaced apart along the longitudinal dimension of said body portion;

second fastening means on said container body portion located diametrically opposite said first fastening means and including a gripping jaw element mounted on each container body portion, said gripping jaw element having a pair of spaced projecting members and a base having an edge spaced from said container body and connecting said projecting members together to define a blind-ended opening, said gripping jaw element being mounted on said container body portion so that said blind-ended opening is coplanar with a plane intersecting said container body portion and so that said projecting members are spaced apart along the longitudinal dimension of said container body portion, said gripping jaw elements having means for gripping said tongue element so that a gripping jaw element of one container releasably locks with a tongue element of an adjacent container to couple those adjacent containers together so that a unit formed of the coupled containers can assume a curved configuration, whereby said unit can be carried in a pocket, said tongue and gripping jaw elements being reconnectable with each other after separation.

8. The unit of claim 7, further including a plurality of first and second fastening means.

9. The unit of claim 5, wherein said curved configuration is circular.

* * * * *